US007145758B2

(12) United States Patent
King et al.

(10) Patent No.: US 7,145,758 B2
(45) Date of Patent: Dec. 5, 2006

(54) ARC SUPPRESSION CIRCUIT FOR ELECTRICAL CONTACTS

(75) Inventors: Ray King, Carolina Beach, NC (US); Lyle Bryan, Winston-Salem, NC (US)

(73) Assignee: International Rectifier Corporation, El Segundo, CA (US)

( * ) Notice: Subject to any disclaimer, the term of this patent is extended or adjusted under 35 U.S.C. 154(b) by 286 days.

(21) Appl. No.: 10/440,586

(22) Filed: May 19, 2003

(65) Prior Publication Data

US 2004/0052011 A1 Mar. 18, 2004

Related U.S. Application Data

(60) Provisional application No. 60/412,630, filed on Sep. 19, 2002, provisional application No. 60/381,662, filed on May 17, 2002.

(51) Int. Cl.
*H01H 9/30* (2006.01)

(52) U.S. Cl. ..... 361/3; 361/2; 361/13

(58) Field of Classification Search ..... 361/3, 361/2, 13

See application file for complete search history.

(56) References Cited

U.S. PATENT DOCUMENTS

| | | | | |
|---|---|---|---|---|
| 4,644,300 | A * | 2/1987 | Ibe et al. | 331/111 |
| 4,658,320 | A * | 4/1987 | Hongel | 361/13 |
| 5,081,558 | A * | 1/1992 | Mahler | 361/13 |
| 5,652,688 | A * | 7/1997 | Lee | 361/13 |
| 5,703,743 | A * | 12/1997 | Lee | 361/6 |
| 6,671,142 | B1 * | 12/2003 | Beckert et al. | 361/2 |

* cited by examiner

*Primary Examiner*—Brian Sircus
*Assistant Examiner*—Zeev Kitov
(74) *Attorney, Agent, or Firm*—Ostrolenk, Faber, Gerb & Soffen, LLP

(57) ABSTRACT

A circuit to suppress arc across contacts of a relay is provided, in which the relay is electrically coupled to a power supply and a load. The circuit includes an arc suppression circuit electrically coupled between the first and second contacts of the relay, and the arc suppression circuit includes a capacitor and a switch, both of which are electrically coupled to the first and second contacts of the relay, in which the switch is configured to turn on when the first and second contacts of the relay change state, thereby providing an alternate path for a current flow through the load.

18 Claims, 8 Drawing Sheets

ARC SUPPRESSION CIRCUIT FOR ELECTRICAL CONTACTS

RELATED APPLICATIONS

The present application is based on and claims the benefit of U.S. Provisional Application Ser. No. 60/381,662, filed on May 17, 2002, entitled ARC SUPPRESSING CIRCUIT FOR ELECTRICAL CONTACTS, and the present application is based on and claims the benefit of U.S. Provisional Application Ser. No. 60/412,630, filed Sep. 19, 2002, entitled ARC SUPPRESSING CIRCUIT FOR ELECTRICAL CONTACTS, the entire contents of both of which are expressly incorporated herein by reference.

FIELD OF THE INVENTION

The present invention relates to an arc suppression circuit for electrical contacts, and in particular, for relay contacts.

BACKGROUND INFORMATION

In many applications, it may be necessary to prevent voltage arcing across electrical contacts, for example, to prevent arcing across electrical contacts of a relay. With respect to inductive loads, such motors, closing of the relay contacts causes a magnetic filed to be generated in the load. At a subsequent time, the relay contacts open, thereby causing the magnetic field to collapse. However, since current flow through an inductor cannot change instantaneously, a back EMF is generated across the inductive load, which causes the voltage across the inductive load to rise rapidly. This rapid rise in voltage (i.e., a voltage spike) may cause an arc to traverse across the relay contacts. Over a period of time, such arcing may cause, for example, deposits on the relay contacts, thereby reducing the effectiveness of the relay contacts.

Referring now to FIG. 5, there is seen a conventional relay circuit 500 having no arc suppression circuitry. Relay circuit 500 includes relay contacts 505 coupled in series with a power supply 510 and an inductive load 515. While relay contacts 505 remain closed, current flows from power supply 510, and through both inductive load 515 and relay contacts 505. When relay contacts 505 are opened, the back EMF generated across inductive load 515 causes the voltage across the inductive load 515 to sharply rise, as shown in the oscillogram of FIG. 6. This increased voltage may cause an arc to traverse across relay contacts 505.

To prevent the occurrence of such arcing, it is known to connect a capacitor (i.e., an arc suppression capacitor) in parallel with the relay contacts. The capacitor provides an alternate path for current flow through the inductive load when the relay contacts open. In this manner, current flowing through the inductive load flows into and charges the capacitor, thereby causing the voltage across the relay contacts to rise more slowly as compared to a circuit having no arc suppression capacitor. Furthermore, to improve the performance of the arc suppression capacitor, it is known to connect a parallel resistor-diode pair in series with the capacitor, as shown in FIG. 8.

It will be appreciated by those skilled in the art that, if the capacitor charges too quickly, a back EMF may still be generated across the inductive load, which may still cause an arc to traverse across the relay contacts. Thus, to ensure proper arc suppression, the capacitor should be chosen to have a large enough capacitance to accommodate the decaying current produced by the inductive load. However, such large capacitors result in increased cost and circuit size.

SUMMARY OF THE INVENTION

It is an object of the present invention to overcome the disadvantages described above by providing a circuit configured to suppress arcing across electrical contacts, for example, the electrical contacts of a relay, which may operate using a relatively small capacitor. For this purpose, a switching device, for example, a FET device, is arranged in parallel across both the capacitor and the contacts of the relay. The switching device turns on when the relay contacts are opened, thereby providing an alternate path for the current generated by the inductive load. Since current is diverted (i.e., snubbed) through the FET device, the capacitor charges more slowly, thereby reducing both the back EMF generated across the inductive load and the probability of arcing across the relay contacts.

By reducing the probability of arcing, a relay having a lower voltage rating may be used in applications requiring relays having higher voltage ratings. For example, the arc suppression circuit according to the present invention may permit a 12V relay to be used in place of a 42V relay in automobile applications.

DETAILED DESCRIPTION

Figure 1:
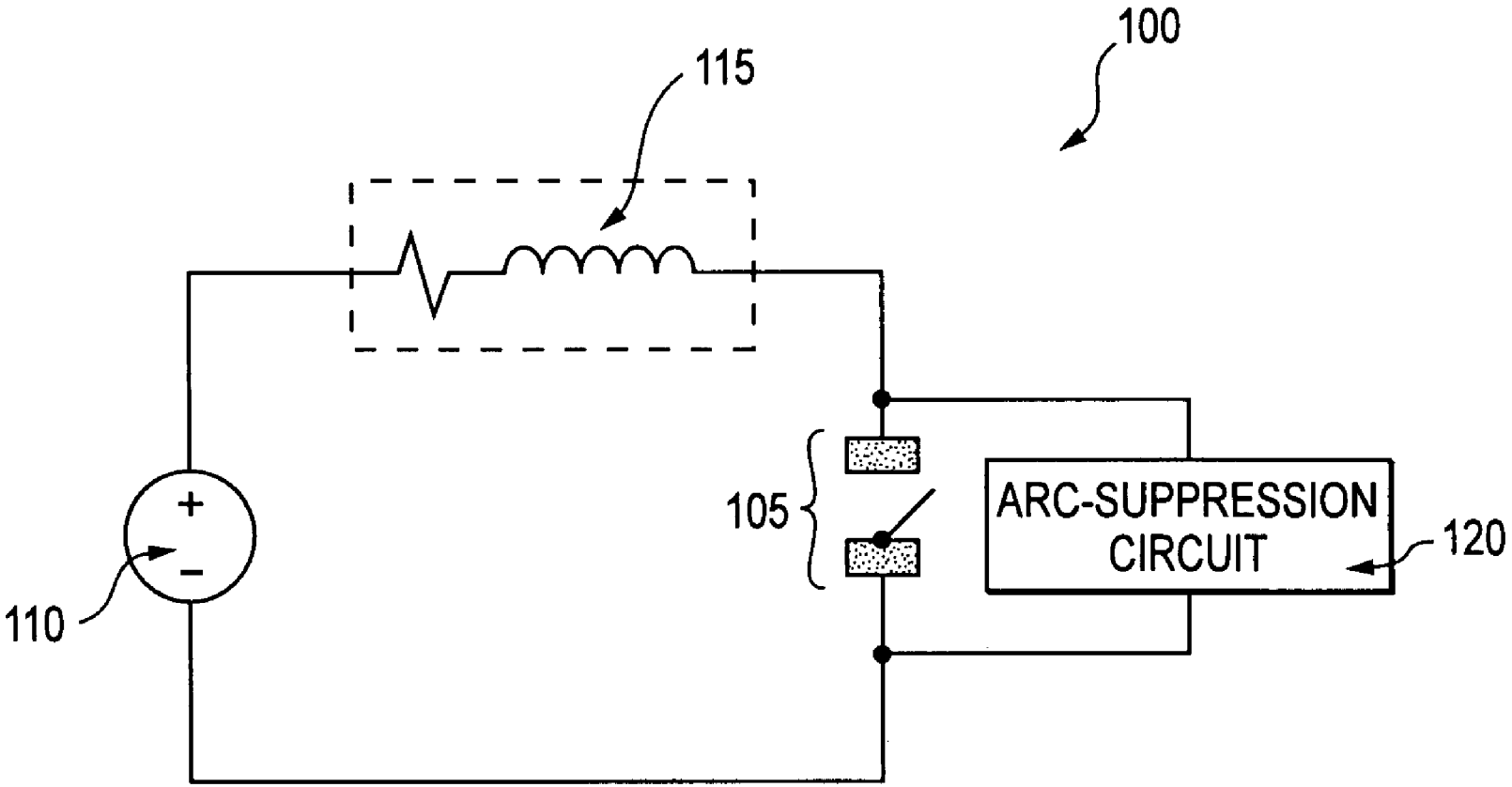
FIG. 1 illustrates a first circuit for suppressing arcing across relay contacts according to the present invention.

Referring now to FIG. 1, there is seen a first exemplary circuit 100 according to the present invention. Arc suppression circuit 100 includes relay contacts 105 coupled in series with a power supply 110 and an inductive load 115. First exemplary circuit 100 also includes an arc suppression circuit 120 coupled in parallel with relay contacts 105. The relay coil is not shown in any of the Figures.

Figure 2:
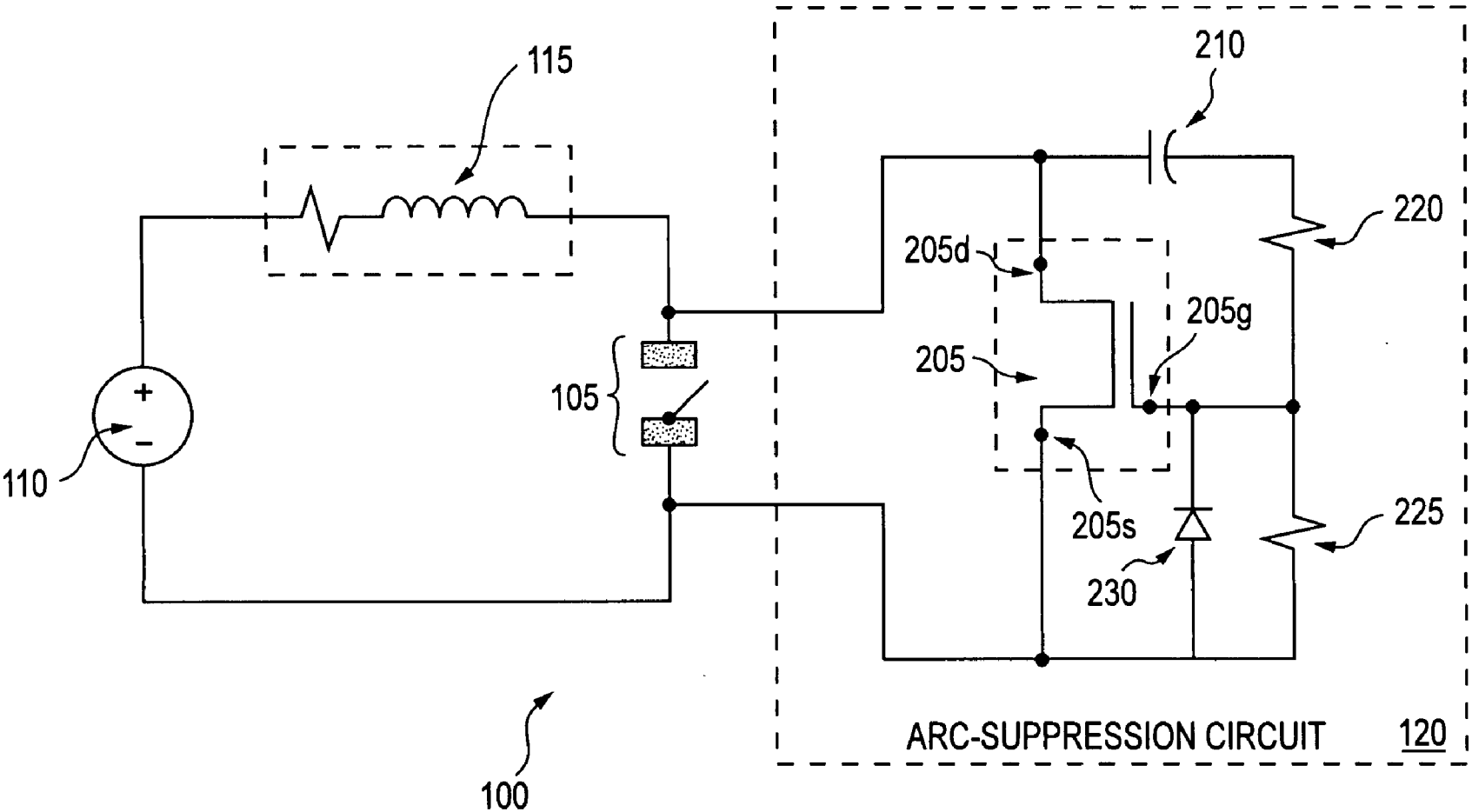
FIG. 2 illustrates the circuit of FIG. 1, in which the arc suppression circuit includes a FET switch electrically coupled in parallel with relay contacts.

Referring now to FIG. 2, there is seen the first exemplary circuit 100 of FIG. 1, in which the arc suppression circuit 120 includes a FET switch 205 electrically coupled in parallel with relay contacts 105, a capacitor 210 electrically coupled to drain 205*d* of FET switch 205, a first resistor 220 electrically coupled between capacitor 210 and gate 205*g* of FET switch 205, a second resistor 225 electrically coupled between gate 205*g* of FET switch 205 and source 205*s* of FET switch 205, and a diode 230 electrically coupled between gate 205*g* of FET switch 205 and source 205*s* of FET switch 205. Arc suppression circuit 120 may be constructed from multiple discrete elements, or, for example, may be constructed as a stand-alone module. The module may include, for example, a TO-220 packaged FET switch 205 (and other components) integrated with a relay.

While relay contacts 105 remain closed, current flows from power supply 110, and through both inductive load 115 and relay contacts 105. Since the voltage across the relay contacts is substantially zero volts, FET switch 205 remains turned off.

When relay contacts 105 are opened, the back EMF generated across inductive load 115 causes the voltage at drain 205*d* of FET switch 205 to rise sharply, which causes a positive gate-to-source voltage to appear at gate 205*g* of FET switch 205. This causes FET switch 205 to turn on, thereby providing an alternate path for current flow through inductive load 115. In this manner, the current generated by the back EMF across inductive load 115 is effectively shunted, thereby reducing the probability of arcing across relay contacts 105. Once the voltage spike dissipates, FET switch 205 turns off.

By providing an alternate path for current flow from inductive load 115 through FET switch 205, suppression circuit 120 has the effect of "amplifying" the capacitance of capacitor 210, so that capacitor 210 appears to possess a larger capacitance, such as, for example, a capacitor having a capacitance of 3200 μF. In this manner, the back EMF generated by the inductive load is effectively reduced, thereby reducing the probability of arcing.

Figure 5:
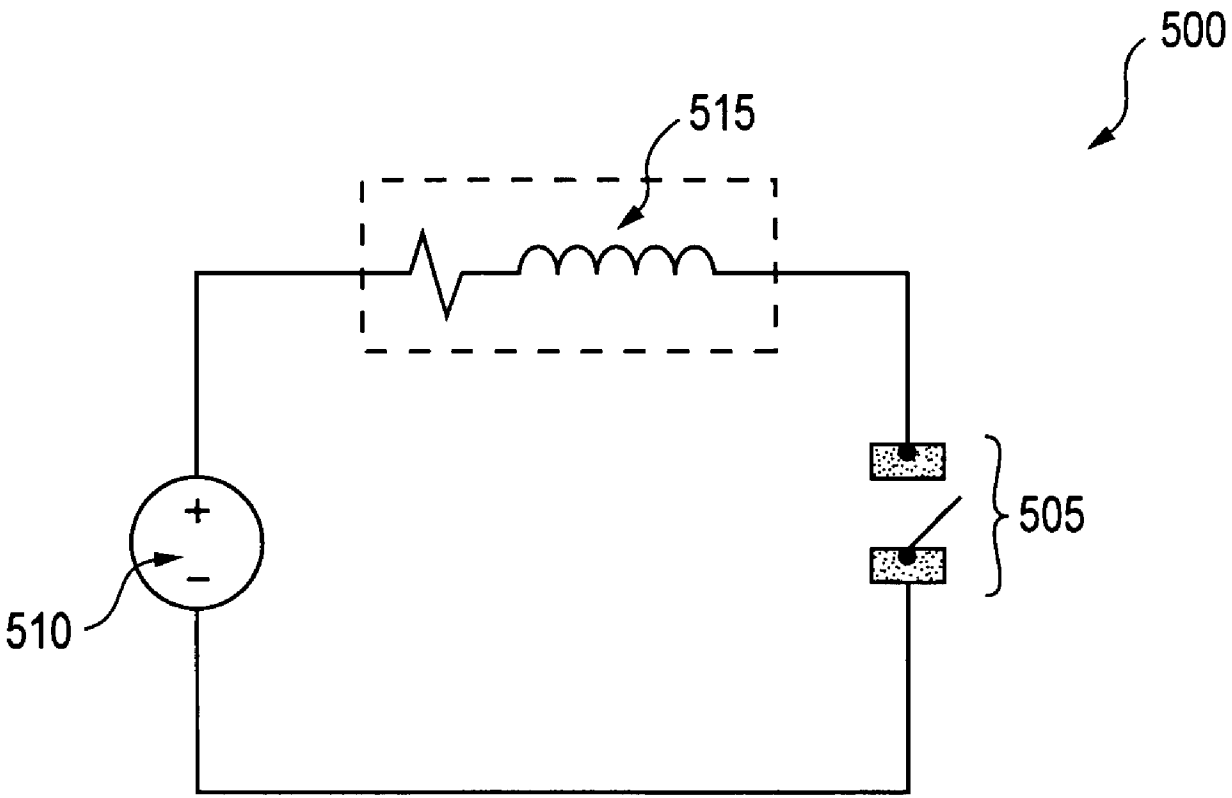
FIG. 5 PRIOR ART
FIG. 5 illustrates a conventional relay circuit.
Figure 6:
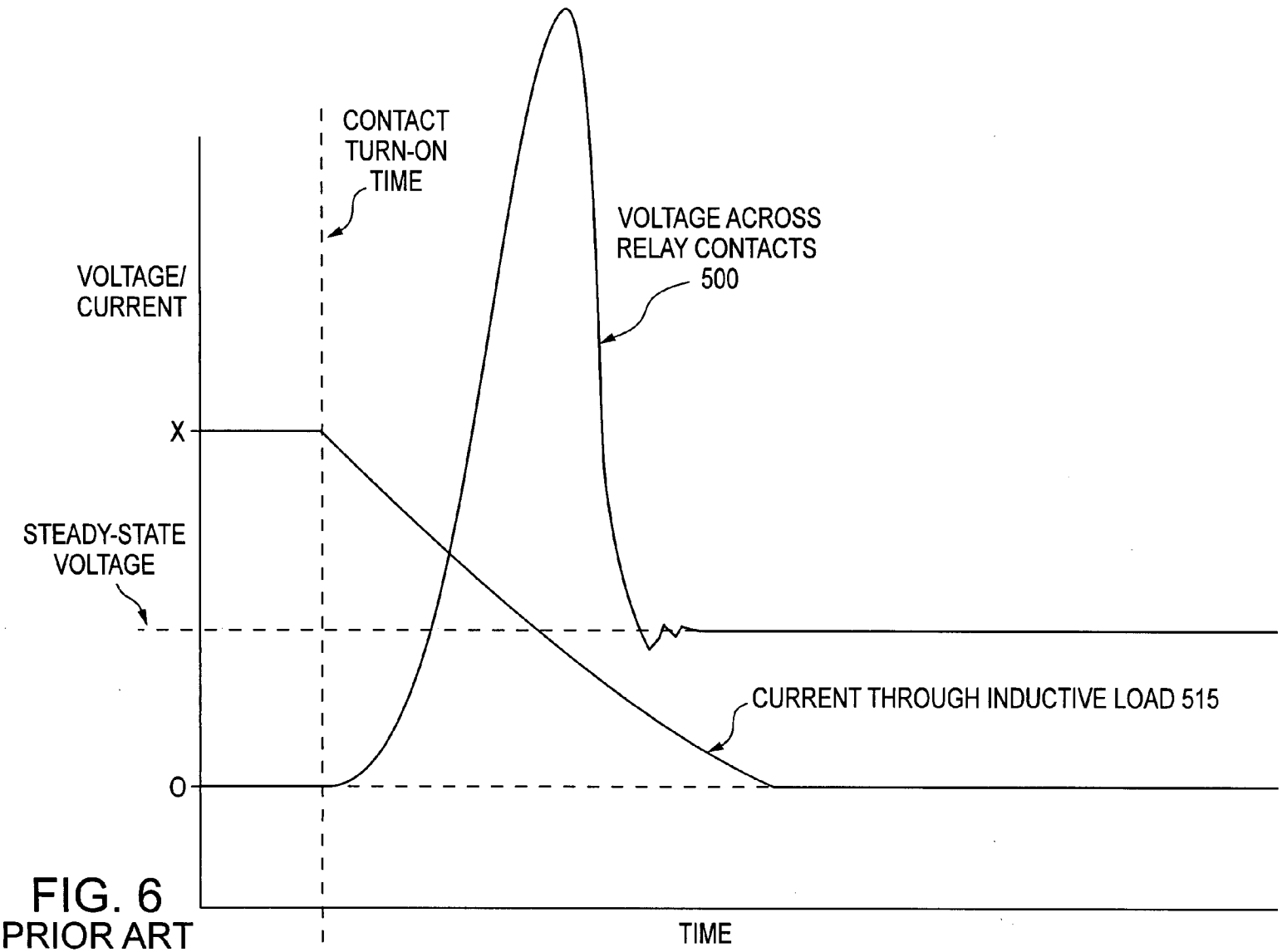
FIG. 6 PRIOR ART
FIG. 6 shows an oscillogram for the conventional relay circuit of FIG. 5.
Figure 7:
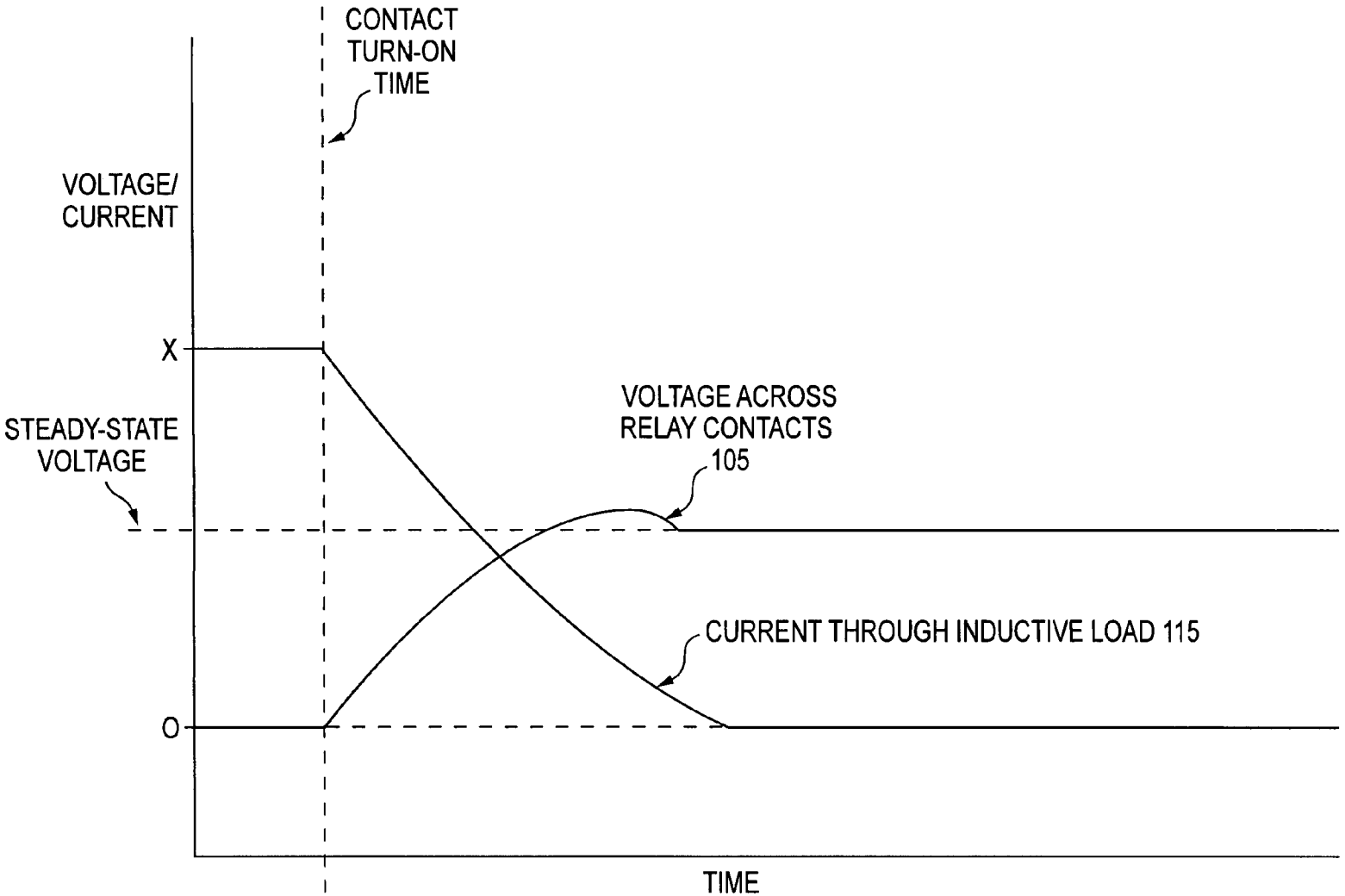
FIG. 7 shows an oscillogram for the exemplary arc suppression circuit of FIG. 2.
Figure 8:
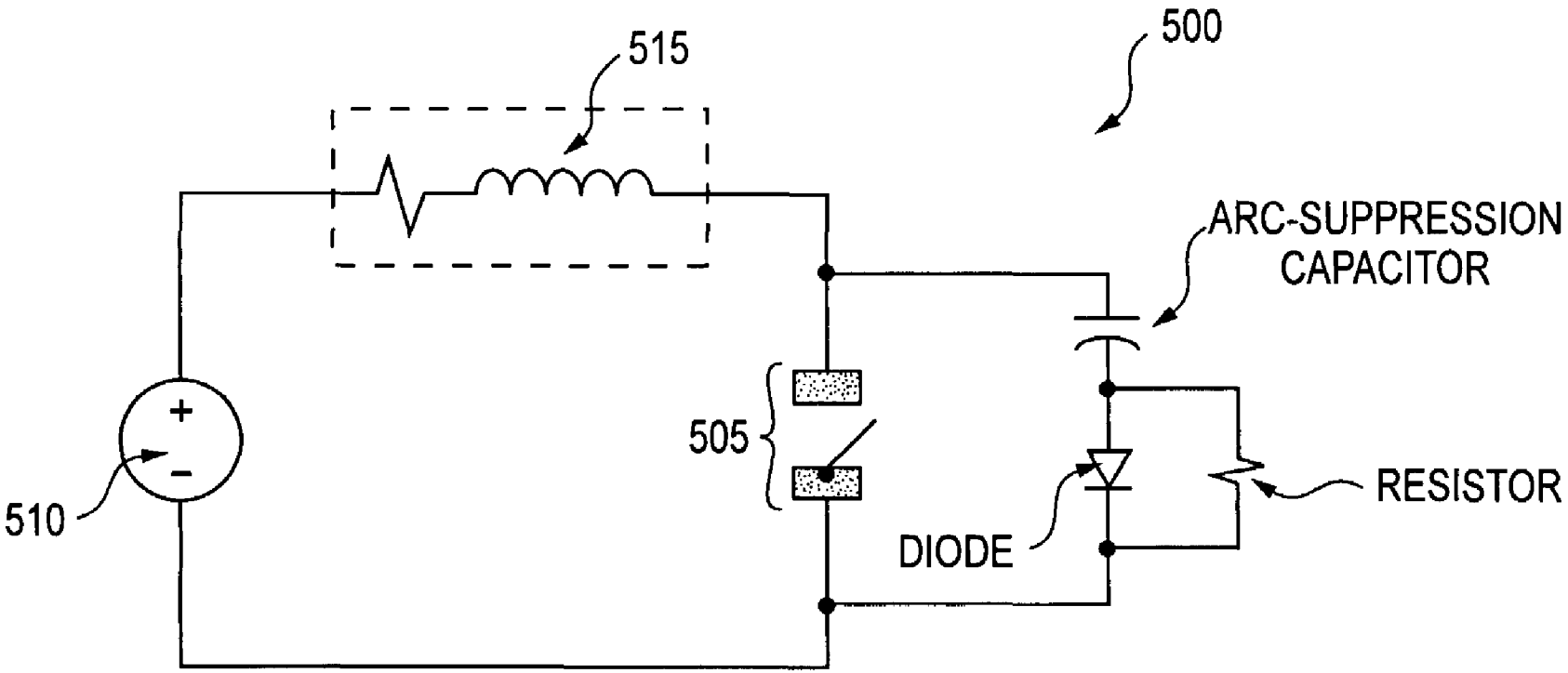
FIG. 8 PRIOR ART
FIG. 8 illustrates a conventional relay circuit including an a capacitor and a parallel resistor-diode pair coupled in series with the capacitor.

Referring now to FIG. 7, there is seen an oscillogram showing the voltage across relay contacts 105, as well as the current through relay contacts 105. Unlike conventional relay circuit 500 of FIG. 5, the voltage across relay contacts 105 does not sharply rise above the steady state voltage level when relay contacts 105 are opened. Rather, the voltage gradually rises to the steady state voltage level with little or no overshoot.

Capacitor 210, first resistor 220, and second resistor 225 may be selected, for example, to reduce voltage oscillations and/or to adjust the time required for gate 205*g* of FET switch 205 to reach a maximum and/or desired voltage with respect to source 205*s* of FET switch 205. For example, capacitor 210 may be selected to have a capacitance of 0.1 μF, first resistor 220 may be selected to have a resistance of 780 Ω, and second resistor 225 may be selected to have a resistance of 10 kΩ. In this manner, arc suppression circuit 120 permits the turn-on voltage of FET switch 205 to be adjusted.

Figure 3:
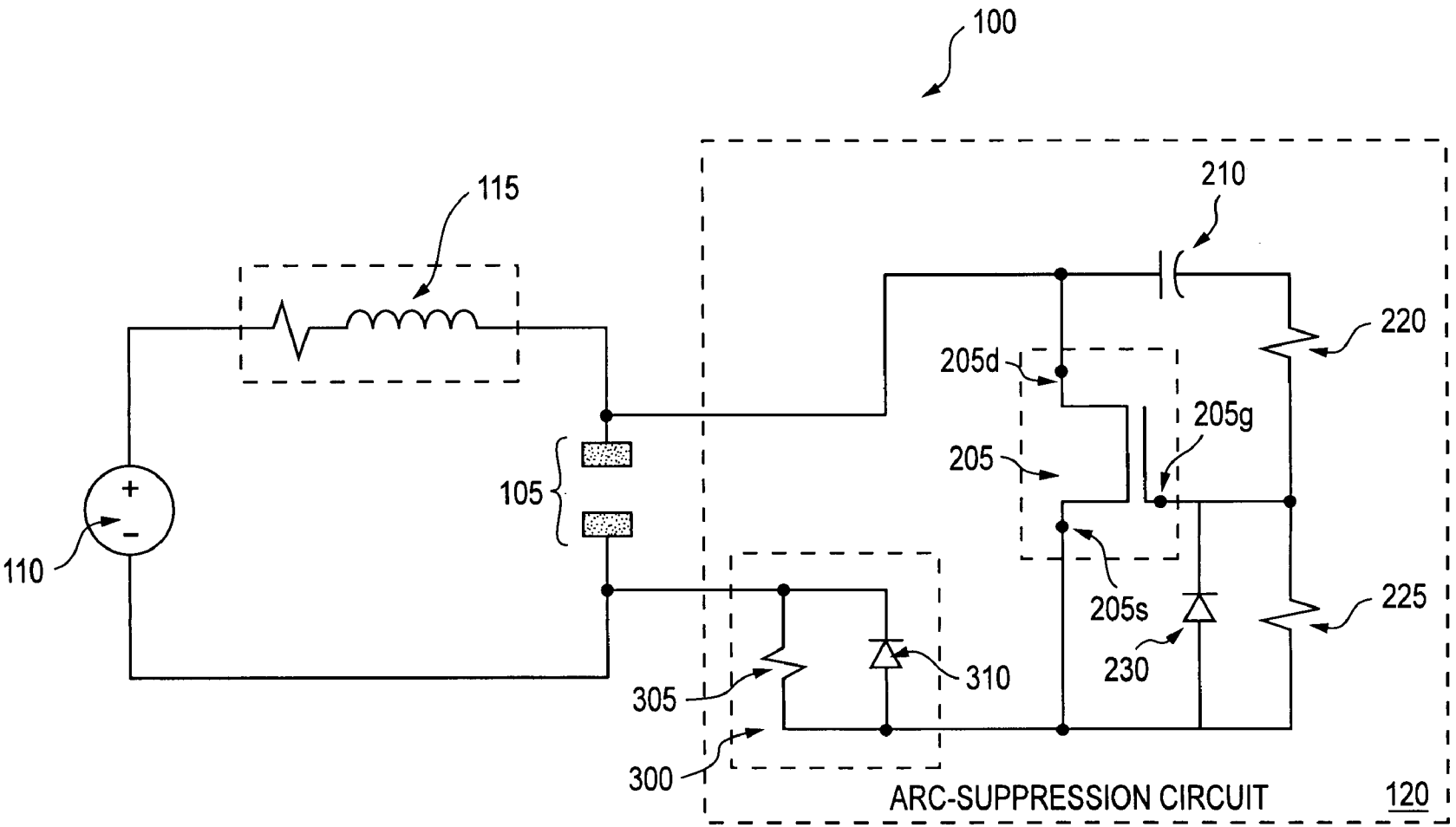
FIG. 3 illustrates the circuit of FIG. 2, in which the arc suppression circuit further includes a battery protection circuit

Referring now to FIG. 3, there is seen the first exemplary circuit 100 of FIG. 2, in which arc suppression circuit 120 further includes a reverse battery protection circuit 300 configured to protect FET 205 from application of a reverse battery voltage, for example, if power supply 110 is connected in reverse, or, with respect to automobile applications, if an operator attempts to reverse-jump an automobile. As shown in FIG. 3, reverse battery protection circuit 300 includes a third resistor 305 and a second diode 310, both of which are electrically coupled between one of the relay contacts 105 and source 205*s* of FET switch 205.

Figure 4:
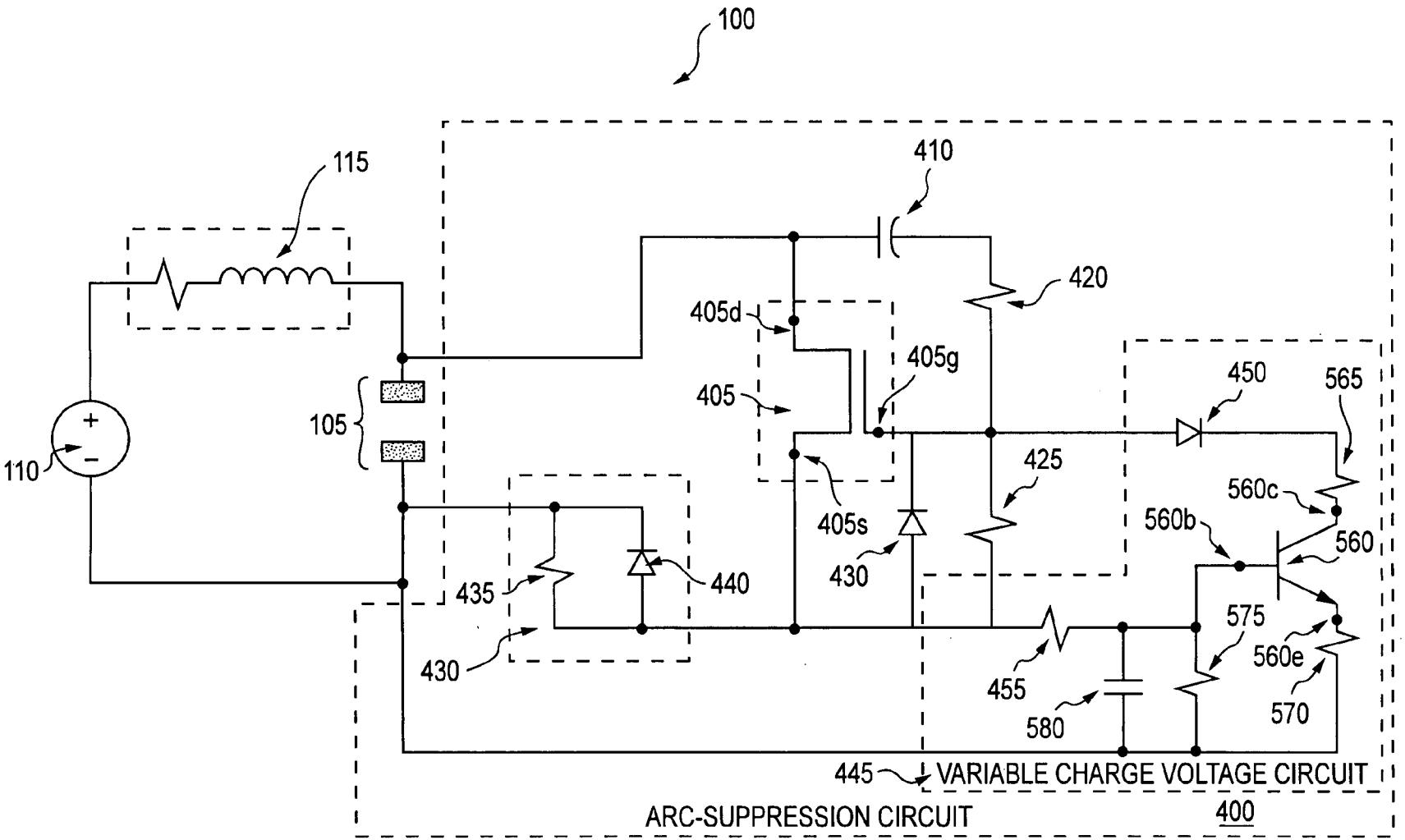
FIG. 4 illustrates another exemplary arc suppression circuit according to the present invention for varying the rate at which a capacitor charges in accordance with current flowing through inductive load.

Referring now to FIG. 4, there is seen the circuit 100 of FIG. 1, including another exemplary arc suppression circuit 400 according to the present invention. Arc suppression circuit 400 includes features similar to those of the various exemplary embodiments described above. For example, arc suppression circuit 400 includes a FET switch 405 electrically coupled between relay contacts 105, a capacitor 410 electrically coupled to drain 405*d* of FET switch 405, a first resistor 420 electrically coupled between capacitor 410 and gate 405*g* of FET switch 405, a second resistor 425 electrically coupled between gate 405*g* of FET switch 405 and source 405*s* of FET switch 405, and a diode 430 electrically coupled between gate 405*g* of FET switch 205 and source 405*s* of FET switch 405. Arc suppression circuit 400 also includes a reverse battery protection circuit 430, having a third resistor 435 and a second diode 440, both of which are electrically coupled between one of relay contacts 105 and source 405*s* of FET switch 405.

Unlike the various exemplary embodiments described above, however, arc suppression circuit 400 also includes a variable charge voltage circuit 445 configured to vary the rate at which capacitor 410 charges in accordance with the current flowing through inductive load 115. Variable charge voltage circuit 445 includes a third diode 450 electrically coupled to gate 405*g* of FET switch 205, a fourth resistor 455 electrically coupled to source 405*s* of FET switch 405, transistor 560 electrically coupled to fourth resistor 455 via base node 560*b*, a fifth resistor 565 electrically coupled between collector node 560*c* of transistor 560 and third diode 450, a sixth resistor 570 electrically coupled between emitter node 560*e* of transistor 560 and second diode 440, a seventh resistor 575 electrically coupled between base node 560*b* of transistor 560 and second diode 440, and a second capacitor 580 electrically coupled between base node 560*b* of transistor 560 and second diode 440.

Arc suppression circuit 400 is configured to change the rate at which capacitor 410 charges in accordance with the current flowing through inductive load 115, thereby affecting the turn-on characteristics of FET 405. In this manner, arc suppression circuit 400 reduces the amount of energy dissipated during arc suppression. This offers further protection against over-voltage and arcing, and permits two or more circuits 100 to be coupled in parallel for power sharing.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A circuit to suppress arc across first and second contacts of a relay, the relay being electrically coupled to a power supply and an inductive load, the circuit comprising:

an arc suppression circuit coupled between the first and second contacts of the relay, the arc suppression circuit including a first capacitor and an FET switch, the FET switch having a drain terminal and a source terminal each electrically coupled to a respective one of the first and second contacts of the relay, the first capacitor being coupled to one contact of the relay and to the FET switch; and a variable charge voltage circuit configured to vary a rate at which the first capacitor charges in accordance with the current flowing through the inductive load, wherein the switch is configured to turn on when the first and second contacts of the relay are opened, thereby providing an alternate path for a current flow through the inductive load.

2. The circuit according to claim 1, wherein the FET switch includes a gate, a drain, and a source, the FET switch being electrically coupled between the first and second contacts of the relay, the first capacitor being electrically coupled to the drain of the FET switch, the arc suppression circuit further including a first resistor electrically coupled between the first capacitor and the gate of the FET switch, a second resistor electrically coupled between the gate of the FET switch and the source of the FET switch, and a diode electrically coupled between the gate of the FET switch and the source of the FET switch.

3. The circuit according to claim 2, wherein the arc suppression circuit further includes a reverse battery protection circuit.

4. The circuit according to claim 3, wherein the reverse battery protection circuit includes a third resistor and a second diode, both of which are electrically coupled between one of the first and second contacts of the relay and the source of the FET switch.

5. A circuit to suppress arc across first and second contacts of a relay, the relay being electrically coupled to a power supply and an inductive load, the circuit comprising:

an arc suppression circuit coupled between the first and second contacts of the relay, the arc suppression circuit including a first capacitor and an FET switch, wherein the switch is configured to turn on when the first and second contacts of the relay are opened, thereby providing an alternate path for a current flow through the inductive load;

wherein the FET switch includes a gate, a drain, and a source, the FET switch being electrically coupled between the first and second contacts of the relay, the first capacitor being electrically coupled to the drain of the FET switch, the arc suppression circuit further including a first resistor electrically coupled between the first capacitor and the gate of the FET switch, a second resistor electrically coupled between the gate of the FET switch and the source of the FET switch, and a diode electrically coupled between the gate of the FET switch and the source of the FET switch;

wherein the arc suppression circuit further includes a variable charge voltage circuit configured to vary a rate at which the first capacitor charges in accordance with the current flowing through inductive load.

6. The circuit according to claim 5, wherein the variable charge voltage circuit includes a third diode electrically coupled to the gate of the FET switch, a fourth resistor electrically coupled to the source of the FET switch, a transistor electrically coupled to the fourth resistor via a base node, a fifth resistor electrically coupled between a collector node of the transistor and the third diode, a sixth resistor electrically coupled between an emitter node of the transistor and the second diode, a seventh resistor electrically coupled between the base node of the transistor and the second diode, and a second capacitor electrically coupled between the base node of the transistor and the second diode.

7. The circuit according to claim 6, wherein the arc suppression circuit further includes a reverse battery protection circuit.

8. The circuit according to claim 7, wherein the reverse battery protection circuit includes a third resistor and a second diode, both of which are electrically coupled between one of the first and second contacts of the relay and the source of the FET switch.

9. A circuit to suppress arc across first and second contacts of a relay, the relay being electrically coupled to a power supply and a load, the circuit comprising:

an arc suppression circuit coupled between the first and second contacts of the relay, the arc suppression circuit including a first capacitor and an FET switch, the FET switch having a drain terminal and a source terminal each electrically coupled to a respective one of the first and second contacts of the relay, the capacitor being coupled to one contact of the relay and to the switch; and a variable charge voltage circuit configured to vary a rate at which the first capacitor charges in accordance with the current flowing through the load, wherein the switch is configured to turn on when the first and second contacts of the relay change state, thereby providing an alternate path for a current flow through the load.

10. The circuit according to claim 9, wherein the FET switch includes a gate, a drain, and a source, the FET switch being electrically coupled between the first and second contacts of the relay, the first capacitor being electrically coupled to the drain of the FET switch, the arc suppression circuit further including a first resistor electrically coupled between the first capacitor and the gate of the FET switch, a second resistor electrically coupled between the gate of the FET switch and the source of the FET switch, and a diode electrically coupled between the gate of the FET switch and the source of the FET switch.

11. The circuit according to claim 10, wherein the arc suppression circuit further includes a reverse battery protection circuit.

12. The circuit according to claim 11, wherein the reverse battery protection circuit includes a third resistor and a second diode, both of which are electrically coupled between one of the first and second contacts of the relay and the source of the FET switch.

13. A circuit to suppress arc across first and second contacts of a relay, the relay being electrically coupled to a power supply and a load, the circuit comprising:

an arc suppression circuit coupled between the first and second contacts of the relay, the arc suppression circuit including a first capacitor and an FET switch, wherein the switch is configured to turn on when the first and second contacts of the relay change state, thereby providing an alternate path for a current flow through the load;

wherein the FET switch includes a gate, a drain, and a source, the FET switch being electrically coupled between the first and second contacts of the relay, the first capacitor being electrically coupled to the drain of the FET switch, the arc suppression circuit further including a first resistor electrically coupled between the first capacitor and the gate of the FET switch, a second resistor electrically coupled between the gate of the FET switch and the source of the FET switch, and a diode electrically coupled between the gate of the FET switch and the source of the FET switch;

wherein the arc suppression circuit further includes a variable charge voltage circuit configured to vary a rate at which the first capacitor charges in accordance with the current flowing through load.

14. The circuit according to claim 13, wherein the variable charge voltage circuit includes a third diode electrically coupled to the gate of the FET switch, a fourth resistor electrically coupled to the source of the FET switch, a transistor electrically coupled to the fourth resistor via a base node, a fifth resistor electrically coupled between a collector node of the transistor and the third diode, a sixth resistor electrically coupled between an emitter node of the transistor and the second diode, a seventh resistor electrically coupled between the base node of the transistor and the second diode, and a second capacitor electrically coupled between the base node of the transistor and the second diode.

15. The circuit according to claim 14, wherein the arc suppression circuit further includes a reverse battery protection circuit.

16. The circuit according to claim 15, wherein the reverse battery protection circuit includes a third resistor and a second diode, both of which are electrically coupled between one of the first and second contacts of the relay and the source of the FET switch.

17. The circuit according to claim 2, wherein the first and second resistors are connected in series forming a voltage divider between the first capacitor and the source of the FET switch, a junction point between the first and second resistors being connected to the gate of the FET switch, and said diode being connected between said junction point and said source.

18. The circuit according to claim 10, wherein the first and second resistors are connected in series forming a voltage divider between the first capacitor and the source of the FET switch, a junction point between the first and second resistors being connected to the gate of the FET switch, and said diode being connected between said junction point and said source.

* * * * *